United States Patent [19]

Voorheis

[11] 4,285,664

[45] Aug. 25, 1981

[54] BURNER FOR A PLURALITY OF FLUID STREAMS

[76] Inventor: James T. Voorheis, 53 Park La., Essex Fells, N.J. 07021

[21] Appl. No.: 25,873

[22] Filed: Apr. 2, 1979

[51] Int. Cl.[3] ..... F23Q 9/00

[52] U.S. Cl. ..... 431/284; 431/350; 239/424

[58] Field of Search ..... 239/424; 431/350, 354, 431/8, 9, 284

[56] References Cited

U.S. PATENT DOCUMENTS

| | | | |
|---|---|---|---|
| 1,713,260 | 5/1929 | Chandler . | |
| 2,219,696 | 10/1940 | Mueller et al. . | |
| 2,886,946 | 5/1959 | Parker . | |
| 3,213,919 | 10/1965 | Calzolari | 431/9 |
| 3,223,136 | 12/1964 | Mutchler | 431/350 |
| 3,265,313 | 8/1966 | Paris . | |
| 3,576,384 | 4/1971 | Peczell et al. . | |
| 3,773,262 | 11/1973 | Sparling . | |
| 3,814,391 | 6/1974 | Cedarholm . | |
| 3,852,022 | 12/1974 | Medeot et al. . | |
| 3,980,233 | 9/1976 | Simmons et al. | 239/424 |
| 4,019,851 | 4/1977 | Smith et al. | 431/9 |

*Primary Examiner*—Carroll B. Dority, Jr.

*Attorney, Agent, or Firm*—Norman N. Popper; Daniel H. Bobis

[57] ABSTRACT

The burner for a plurality of fluid streams provides a discharge nozzle on the end of a fuel conduit; the fuel conduit is surrounded by an air or gas conduit; in the space between the inner wall of the air conduit and the outer wall of the fuel conduit, an annulus is positioned; the annulus has a bluff downstream end in general registration with the end of the fuel conduit and creates a toroidal turbulent eddy of air or gas that enhances combustion without materially accelerating the atomized fuel.

1 Claim, 2 Drawing Figures

BURNER FOR A PLURALITY OF FLUID STREAMS

BACKGROUND OF THE INVENTION

1. Field of Invention

Figure 1:
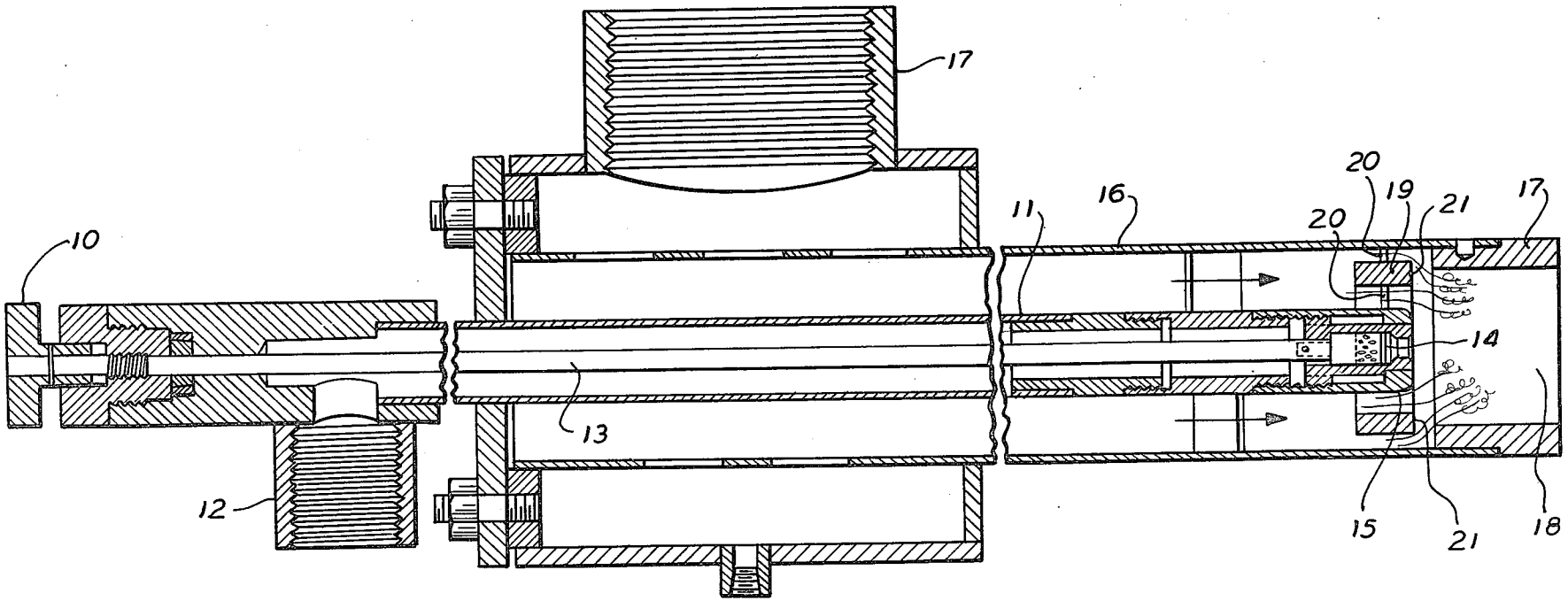

This invention relates generally to burners for combustible material and particularly to a burner for a plurality of fluid streams wherein the air conduit has an annulus positioned therein with a bluff downstream end.

2. Prior Art

Numerous devices have been created for use in fluid streams for discharging air, steam, oil, gas, primary combustion air, or total combustion air. The objective of any of these devices is to improve fuel oil atomization, radiation of heat, and control flame to avoid flame-outs and yet to project the flame front to a point where it is utilized with the highest degree of efficiency. In addition, the mixture of gas or primary air is sought to be conducted with the highest degree of efficiency. While some of these objectives are achieved, others are not. The concurrent achievement of all objectives is the most desirable result.

SUMMARY OF THE INVENTION

It has been found that the use of an annular, bluff body (a velocity ring) spaced away from the outer wall of a gas or fuel conduit and away from the inner walls of the fuel conduit will create toroidal eddies which will enhance the desirable characteristics of the burner without increasing the forward velocity or total input energy required in a combustion system. The effectiveness of the fuel oil's atomizing media is enhanced so that there are multiple particle collisions with the atomizing media; Brownian motion is enhanced in the turbulence area. An upstream motion of a peripheral flame envelope of nebulous fuel particles is induced so that flame retention is improved even though extremely narrow flame emission angles are utilized which normally might extend the combustion zone. The fuel and air particles are more quickly mixed and the flame envelope temperatures are increased. Heat transfer by radiation is improved. It is no longer necessary to spin the atomizing media streams, gas streams, or combustion streams as is often done in order to attempt to achieve complete combustion. Since a vastly enlarged flame develops resulting from spinning can cause flame impingement upon furnace refractory or other components with harmful results, the use of the velocity ring may eliminate such harmful impingement.

DRAWINGS

Figure 2:
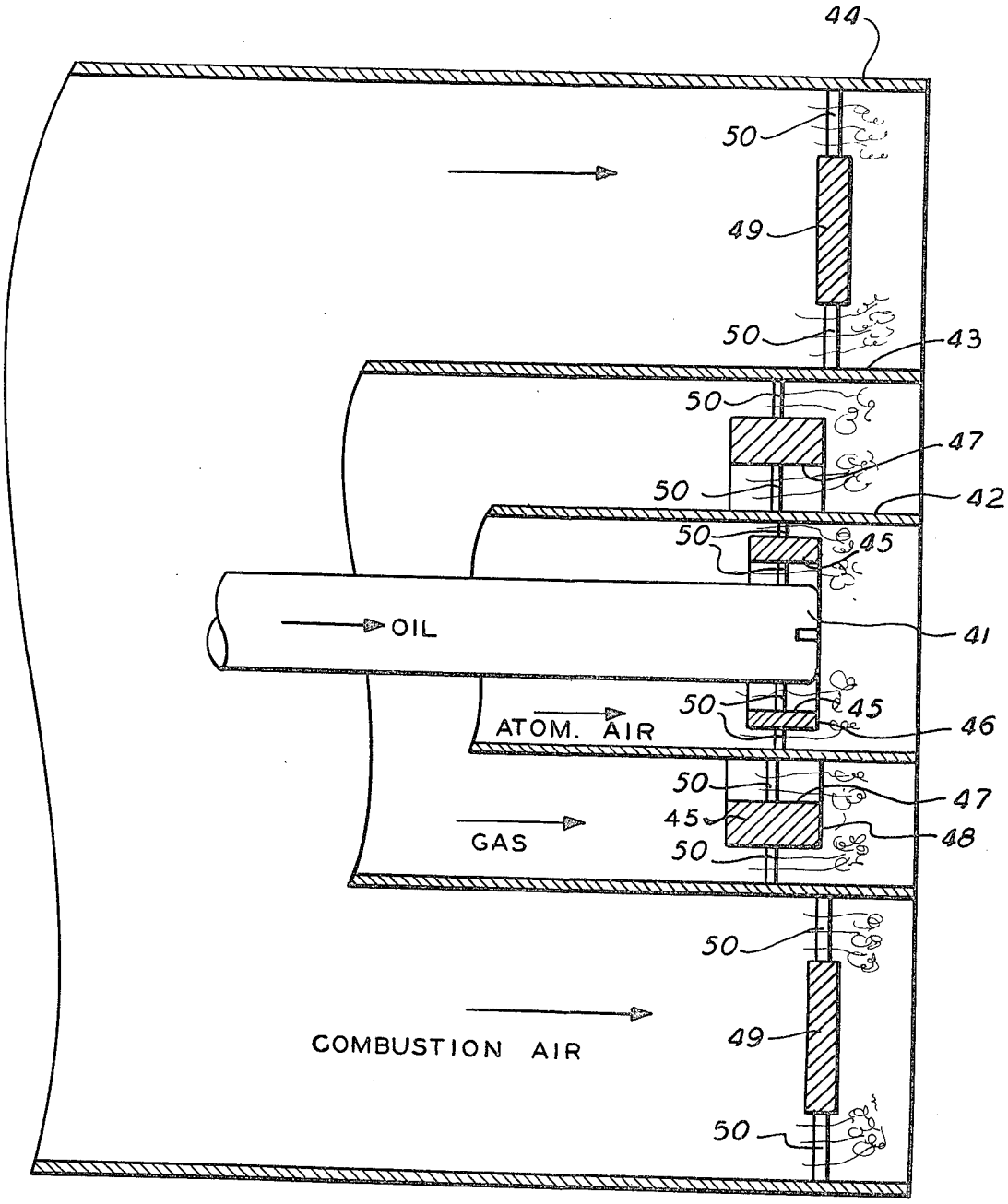

These objects and advantages as well as other objects and advantages may be attained by the device shown by way of illustration in the drawings in which:

FIG. 1 is a kiln burner gun embodying a velocity ring (annular bluff body); and FIG. 2 is a vertical sectional view of a burner gun having a plurality of conduits for combustible material and a plurality of conduits for combustion air.

PREFERRED EMBODIMENT

Referring now to the drawings in detail, the burner gun for a plurality of fluid streams in the embodiment shown in FIG. 1 provides a fuel conduit 11. A fuel inlet 12 communicates with the fuel conduit. A piston 13 passes coaxially through the fuel conduit 11 and the end of the piston is adjustable with respect to the end 15 of the fuel conduit 11 by reason of the piston control knob 10 which causes the end 14 of the piston to adjust spacially with respect to the end 15 of the conduit and in this manner controls the oil flow. Surrounding the fuel conduit 11 is the air or gas conduit 16 which communicates with an inlet 17 for atomizing air or gas. The air or gas conduit extends downstream of the end 14 of the piston. The degree of extension of the air or gas conduit 16 beyond the end 14 of the piston is not critical. An extension 17 may be attached to the air or gas conduit 16 to provide an extended outlet orifice 18. An annulus 19 is positioned in the air or gas conduit 16 at the end 15 of the fuel conduit. This annulus 19 is attached by a support or bracket 20 or a plurality of brackets so that it is generally spaced away from the inner wall of the air or gas conduit 16 and the outer wall of the fuel conduit 11. In this manner, it bisects the air discharge space of the air or gas conduit 16. A critical feature of the present invention is that the annulus 19 has a bluff end wall 21 which is flat and perpendicular to the longitudnal axis of the fuel and air conduits. This flat end 21 of the annulus 19, does not function to smoothly divert the flow of air or gas, but rather creates a toroidal turbulent eddy at the downstream end of the annulus immediately adjacent to the end 15 of the air or gas conduit and the end 14 of the piston from which the fuel is discharged. The flat end 21 of the annulus 19 having a bold perpendicular wall with respect to the longitudinal axis of the burner gun creates an atomizing air (or steam, or gas) flow by reason of the toroidal eddy that improves fuel oil atomization, retains the flame from projection so far that there might be flame-outs and improves radiation. The toroidal eddy contributes to a narrow final emission angle, particularly when the extension or outlet piece 17 is used. Regardless of whether the fuel is liquid, gaseous or pulverized solid, improved flame radiation is achieved as well as flame retention. The annulus 19 is a ring-type, bluff body that does not divert the air or gas flow either centrifugally or centripetally, but rather creates the toroidal eddy without increasing forward velocity or increasing the total input energy to the combustion system. The atomizing media's effectiveness with respect to the fuel oil is enhanced because multiple particle collisions are increased in number, the overall Brownian motion is increased with the improved turbulence area. The thorough mixing of the fuel and gas constituents increases the flame envelope temperatures and heat transfer by radiation is improved. The spinning of the atomizing media's streams, gas streams and combustion air streams is no longer required, and this is most desirable because such spin frequently tends to mushroom the flame and cause impingement on furnace refractory or other components which is not required.

The present invention of an annular bluff body also has application to burner guns wherein a plurality of combustible materials are used. In FIG. 2, there is disclosed a partial sectional view of a burner gun having a conduit 41 for oil, gas or pulverized solid fuel. This conduit 41 is provided with an atomizing tip, not shown. Surrounding the fuel conduit 41 is a conduit 42 for atomizing air. Surrounding the conduit 42 is a second conduit 43 for natural gas. Surrounding the natural gas conduit 43 is still another conduit 44 for combustion air. The atomizing air conduit 42 is provided with a velocity ring 45 which is the bluff body having a generally flat downstream end 46 that produces the toroidal eddy. In the natural gas conduit 43 there is also provided a velocity ring 47 which is ring type bluff body having a flat end 48. Likewise in the combustion air conduit 44 between the gas conduit 43 and the combustion air conduit 44 there is another velocity ring or ring type bluff body 49 to impart toroidal eddies to the oil, to the gas and to the combustion air.

Although reference has been had to oil, it is to be understood that unlimited varities of fuel may be burned, including without limitation coal, pulverized coal, sawdust all involved with any fluid stream.

In this form, support rods 50 are used to hold the various velocity rings in place.

What is claimed is:

1. A burner for a plurality of fluid streams comprising, (a) a first conduit for fuel, (b) a nozzle on the end of the first conduit, to discharge atomized fuel, (c) a second conduit for air or gas surrounding the first conduit, (d) an annulus in the second conduit, (e) the annulus spaced away from the first and second conduits, (f) a flat, downstream bluff end on the annulus disposed perpendicular to the longitudinal axis of the first and second conduits, (g) the downstream bluff end of the annulus disposed in general registration with the nozzle, whereby a toroidal turbulent eddy of gas and fuel is created, (h) a third conduit for air or gas surrounding the second conduit, (i) a second annulus on the third conduit, (j) the second annulus spaced away from the second and third conduits, (k) a flat downstream end on the second annulus, perpendicular to the longitudinal axis of the first, second and third conduits, (l) the downstream end of the second annulus disposed in general registration with the nozzle, whereby the second annulus further contributes to the toroidal, turbulent eddy of gas and fuel.

* * * * *